United States Patent [19]

Okuda

[11] Patent Number: 4,794,939

[45] Date of Patent: Jan. 3, 1989

[54] UMBRELLA WITH SHIRRED EDGE COVER

[75] Inventor: Toshio Okuda, Hirakata, Japan

[73] Assignee: 'totes', incorporated, Loveland, Ohio

[21] Appl. No.: 49,723

[22] Filed: May 12, 1987

[30] Foreign Application Priority Data

Jun. 3, 1986 [JP] Japan ..... 61-58154[U]

[51] Int. Cl.[4] ..... A45B 25/18

[52] U.S. Cl. ..... 135/33 R; 135/20 R

[58] Field of Search ..... 135/33 R, 34, 20, 25

[56] References Cited

U.S. PATENT DOCUMENTS 1,819,912 8/1931 McGaffey ..... 135/33 R

FOREIGN PATENT DOCUMENTS 1177754 12/1958 France ..... 135/33 R
53-10891 4/1978 Japan .
341 of 1870 United Kingdom ..... 135/33 R
194380 3/1923 United Kingdom ..... 135/20
1040647 9/1966 United Kingdom ..... 135/33 R
1051044 12/1966 United Kingdom ..... 135/20
1493389 11/1977 United Kingdom ..... 135/33 R

*Primary Examiner*—J. Karl Bell
*Attorney, Agent, or Firm*—Wood, Herron & Evans

[57] ABSTRACT

An umbrella in which at least a portion of the cover's peripheral edge is shirred. This shirred edge portion is stretched to a greater length when the umbrella is open and contracted to a lesser length when the umbrella is collapsed, thereby providing a taut appearance to the cover when the umbrella is open in the dome-shaped configuration. This invention is particularly useful when the cover is fabricated from a single piece of material, i.e., when the cover is not comprised of separate gores stitched together.

12 Claims, 1 Drawing Sheet

UMBRELLA WITH SHIRRED EDGE COVER

This invention relates to umbrellas. More particularly, this invention relates to an umbrella with a novel cover system.

Umbrellas, of course, are very old in the art. The basic components of an umbrella are the cover, the rib linkage system, and the centerpost, the cover being connected to the rib linkage so that the cover presents a generally dome-shaped configuration when the rib linkage, i.e., when the umbrella, is opened.

Historically, an umbrella's cover has been made of a plurality of gores. The number of gores used in fabricating the cover normally depends on the number of dome ribs in the umbrella's rib linkage. An umbrella with six dome ribs makes use of six gores in the cover, an umbrella with eight dome ribs makes use of eight gores in the cover, and so forth. An umbrella's cover is fabricated from a series of gores so as to permit the cover to take on a generally hemispherical or dome type configuration when the umbrella is opened. In other words, and heretofore, it has not been commercially practical to make an umbrella cover from a single flat piece of regular cover material, e.g., cloth, because it is not possible to form that single piece of umbrella cloth into a smooth hemispherical type dome configuration. This for the reason that the single flat piece of umbrella cloth, when installed on the umbrella's rib linkage, will not permit itself to be formed in a concave dome geometry with a smooth dome surface and with a generally circular periphery when the umbrella is opened. So to obtain the hemispherical dome configuration for an umbrella cover, and according to the prior art, a series of gores, which are generally each of an isosceles triangle configuration, are sewn or stitched together along their major edges. And this has been found a very acceptable way of making umbrella covers over the years.

The prior art plural gore approach of making umbrella covers has a couple of major disadvantages when it is desired to provide the umbrella with a striking artistic design, or with a large advertising message or design, that extends throughout the cover's exterior surface area. This for the reason that the design must be printed on all of the umbrella's gores if the design is to cover, i.e., be visible throughout, the entire exterior surface of the umbrella cover. In manufacture of an umbrella cover with such a large design, it is not practical to try to print the design on the cover when it is dome shaped, but that is the only configuration where the umbrella cover is smooth if it is made of plural gores. This means that part of the design must be printed on each of the individual six or eight gores that make up the dome shaped umbrella cover prior to those gores being sewn together. And this provides a first opportunity for mistake in manufacture of the cover in that if the gores are not precisely printed, then when they are sewn together the design component on any one of the gores may not match up with the design component on an adjacent gore so that the overall cover design does not appear properly matched up when the umbrella is opened. Now there is also a second opportunity for a major mistake in manufacturing the cover, and that is when the gores are sewn together one with the other. Even if the gores are properly printed, if the gores are not properly aligned one with the other by the seamstress sewing them together, then again the design component on one gore may be offset relative to the design component on its adjacent gore, thereby adversely effecting the aesthetics of the overall design. So if the design component printed on each of the gores is not absolutely perfectly placed, and/or if the gores are not exactly lined up edge to edge when stitched together, and if the design extends throughout the entire surface area of the umbrella cover, then that design will not flow correctly from one gore to the other throughout the umbrella cover's exterior surface area, and it may appear quite undesirable to the eye.

Accordingly, it has been a primary objective of this invention to provide an umbrella with an improved cover in which at least a portion of the cover's edge is shirred, the shirred edge being stretched to a greater length when the umbrella is opened and contracted to a lesser length when the umbrella is collapsed, so as to enhance the tautness of the umbrella's cover over the umbrella's rib linkage system when the umbrella is opened.

It has been another objective of this invention to provide an umbrella with an improved cover where the cover is basically fabricated from a single piece of flat material that permits, if desired, an aesthetic design or advertising message to be printed at the same time all throughput the entire surface area of the cover, and that requires no sewing of individual gores relative one to the other in order to provide the final cover configuration, the cover being adapted to provide a hemispherical type dome when assembled with the umbrella's rib linkage and when the umbrella is opened.

It has been a further objective of this invention to provide an umbrella with an improved cover in which the cover is comprised of a single flat material piece cut into a polygonal configuration, at least part of the peripheral edge of that single piece being shirred so that the flat piece will be deformed into a hemispherical type dome configuration when assembled with the umbrella's rib linkage and when the umbrella is opened.

In accord with these objectives, this invention contemplates

An umbrella in which at least a portion of the cover's peripheral edge is shirred. This shirred edge portion is stretched to a greater length when the umbrella is open and contracted to a lesser length when the umbrella is collapsed, thereby providing a taut appearance to the cover when the umbrella is open in the dome-shaped configuration. This invention is particularly useful when the cover is fabricated from a single piece of material, i.e., when the cover is not comprised of separate gores stitched together.

Other objectives and advantages of this invention will be more apparent from the following detailed description taken in conjunction with the drawings in which.

Figure 2:
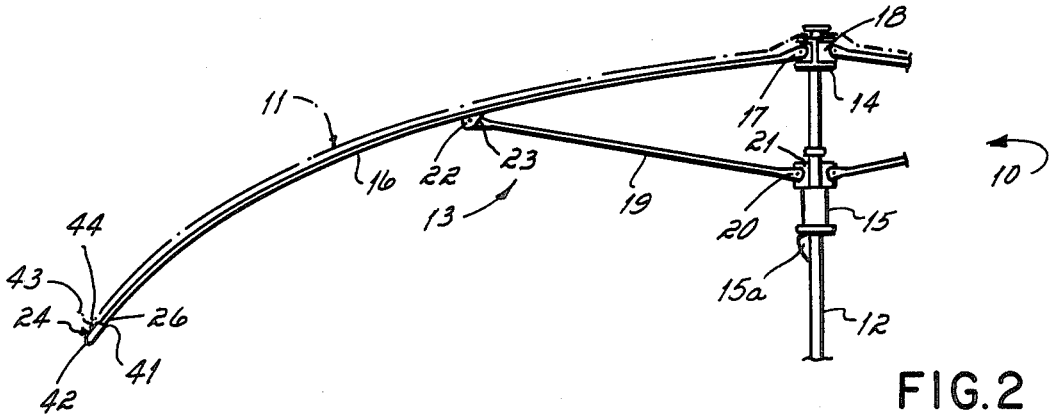
FIG. 2 is a cross-sectional view taken along lines 2—2 of FIG. 1.
Figure 1:
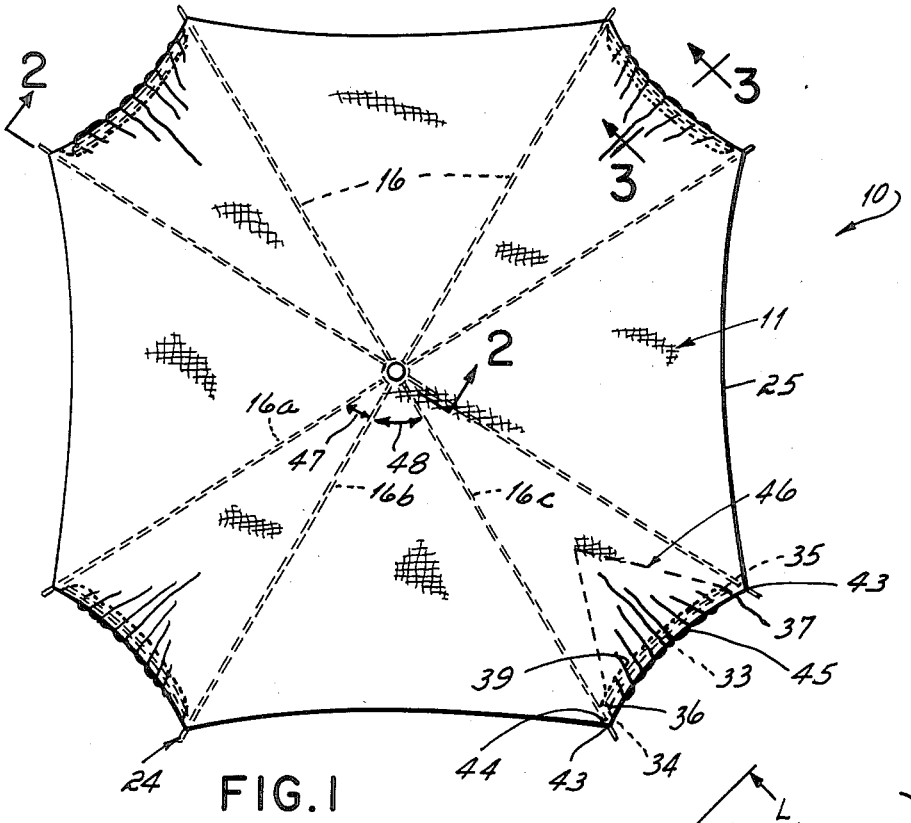
FIG. 1 is a top plan view illustrating an umbrella with a cover in accord with the principles of this invention, the umbrella being in the opened configuration.

An umbrella 10 with shirred edge cover 11 in accord with the principles of this invention is basically illustrated in FIGS. 1 and 2. The umbrella 10 basically includes a centerpost 12, a rib linkage system 13, and the cover 11. A ferrule 14 is fixed to the top end of the centerpost 12, and runner 15 is slideable on the centerpost between an umbrella opened position shown in FIG. 2 in solid lines and an umbrella closed position, not shown. A spring-loaded catch 15a of any type well known to the art is used to hold the runner 15 in the umbrella opened position. The rib linkage system 13 in the embodiment shown is comprised of eight dome ribs 16, each of which is pivotally mounted as at 17 in slot 18 of the ferrule 14 at its inner end. A stretcher rib 19 associated with each dome rib 16 is pivotally mounted as at 20 at its inner end within slot 21 of the runner 15, and is pivotally mounted as at 22 at its outer end to ear 23 fixed to its dome rib 16. The cover 11 is provided with a series of sockets 24 sewn to its periperal edge 25, each socket being received over free end 26 of a dome rib 16. Accordingly, and when the runner 15 is moved from its collapsed position, not shown, to the solid line open position shown in FIG. 2, the umbrella's cover 11 is stretched over the dome ribs 16 in a hemispherical type dome configuration.

Figure 3:
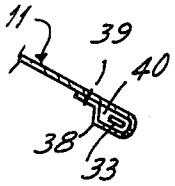
FIG. 3 is a cross-sectional view taken along lines 3—3 of FIG. 1.
Figure 4:
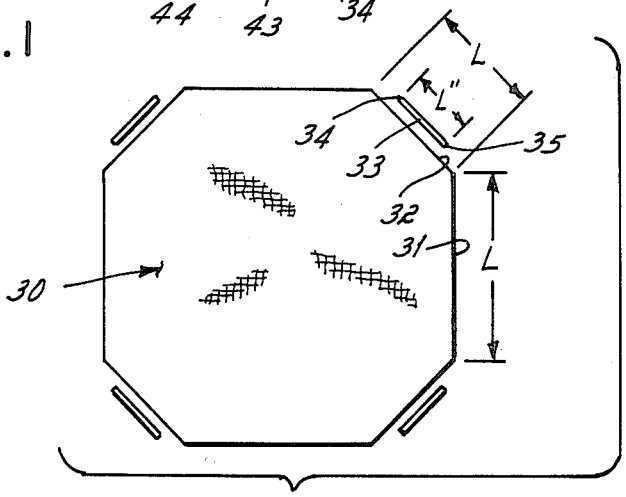
FIG. 4 is a top plan view showing the cover in as-cut flat configuration prior to assembly with the other umbrella components.

The structure of the shirred edge cover 11 is particularly shown in FIGS. 1, 3 and 4. The shirred edge cover 11, as shown in FIG. 4, is cut in a single cover piece 30 from a sheet of material, e.g., cloth. The cover piece 30 is of a completely flat configuration when laid on a flat surface prior to shirring of certain portions of the cover's edge 25 as explained in detail below. The cover piece 30 is of a generally polygonal configuration (as shown in FIG. 4) prior to shirring of certain portions of the cover's edge 25, and the number of edge portions 31, 32 of that polygonal configuration are equal to the number of dome ribs 16 in the umbrella's rib linkage system 13 with which the cover is to be used. In the embodiment illustrated, the one-piece cover 30 is of an irregular octagonal configuration in that the cover piece's edge 25 is comprised of four lesser length edge portions 32 that alternate with four greater length edge portions 31, a total of eight such edge portions 31, 32 being provided to cooperate with eight dome ribs 16 in the rib linkage system 13. The edges of the greater length edge portions 31 are finished vis-a-vis the as-cut flat sheet material 30 by providing a rolled edge hem, not shown. Preferably the length L of each lesser length edge portions 32 is between about forty percent and about eighty percent the length L′ of each greater length edge portion 31, a length relation of about sixty percent being illustrated in the embodiment shown. Preferably the cover piece 30 is cut out or made from an essentially non-stretchable fabric material, i.e., a material that is essentially non-stretchable in the warp and weft directions, although such material is stretchable to some minor degree in a technical sense particularly along the diagonal of the warp and weft directions. Of course materials other than cloth can be used such as, e.g., plastic sheet material or indeed even inherently stretchable material such as a knitted fabric which is stretchable to some limited extent.

It is important relative to this invention that at least one of the cover piece's lesser length edge portions 32 be shirred, and it is preferable that all the lesser length portions be shirred. The shirred edge portions 32 are each created by assembly of an elastic band 33 with that edge portion along the length thereof. The elastic band 33, which preferably has a length L″ between about forty percent and about eighty percent of the edge portion 32 as measured before that edge portion section is shirred (sixty percent being illustrated in the embodiment shown) is stitched at opposed ends 34, 35 to the cover material as shown at 36, 37. A strip of fabric 38 that extends along edge portion 32 is folded under the cover's exterior or outer surface 25 to entrap the elastic band 33 therewithin, and is stitched along stitch line 39 to create a pocket 40 along the length L of edge portion 32 within which the elastic band is located, all as shown in FIGS. 1 and 3. So an elastic band 33 is trapped within a hemmed pocket 40 on the lesser length portions of the irregular polygonal cover piece 30, and the ends 34, 35 of that elastic band are positioned to lie between a pair of adjacent dome ribs **16*a*, 16*b*, when the cover 11 is assembled with the rib linkage system 13 and the umbrella is opened as shown in FIG. 2. A hollow socket 24 open at inner end 41 and closed at outer end 42, is stitched by stitching 44 to each point 43 of the cover piece 30. The stitching 44 that connects the hollow sockets 24 to the cover piece 30 also may be the same stitching 36, 37 that connects the band ends 34, 35** to that cover piece.

In use, the unique advantages of the shirred edge cover 11 are particularly as illustrated in FIGS. 1 and 2. As shown in FIG. 2, and with the umbrella 10 open, i.e., with the rib linkage system 13 erected, the umbrella cover 11 forms a hemispherical type dome shaped configuration even though it is formed from a single flat piece 30 of sheet material. Now this is accomplished by virtue of the lesser length shirred edge portions 32 being stretched to a greater length when the umbrella is opened as illustrated in FIGS. 1 and 2, and contracted to a lesser length when the umbrella is collapsed (not shown), because of elastic bands 33. The function of the shirred length peripheral edge portions 32 of the umbrella's cover 11 is to maintain the cover in a taut dome-shaped configuration over all of the dome ribs 16 when the umbrella is opened. In this regard, and as illustrated in FIG. 2, note that the shirred edge portions 32 cause a nominal or slight degree of gathering of the cover's sheet material, i.e., cause wrinkles or gathers 45 in the cover's surface, in a generally radially inward directed triangular configuration 46 to minimize the sagging of the cover in that area 46, i.e., to effect the cover's tautness when the umbrella is opened. Now also note, as shown in FIG. 2, that the umbrella's dome ribs 16 terminate at the points 43 of the irregular polygon configured cover piece 30, the acute angle 47 defined by each adjacent dome rib pair **16*a*, 16*b* which incorporates a cover's lesser edge portion 32 being significantly less than the acute angle 48 of each dome rib pair 16*b*, 16*c* that incorporates a cover's greater length edge portion 31. This is the case even though the dome ribs 16 are pivotally secured to the ferrule 14 at generally equi-angular locations around the ferrule's periphery. This angular relationship 47, 48 between adjacent dome rib pairs is achieved by virtue of the fact that the slots 18 within which the dome ribs 16 are pivotally mounted to the ferrule 14, and the slots 21 within which the stretcher ribs 19 are pivotaly mounted to the runner 15, are so wide as to also permit limited pivotal movement of each rib 16, 19 in a plane normal to the centerpost axis, i.e., the tolerance of the grooves 18, 21 is such as to permit limited horizontal swinging movement of each dome rib 16 and each stretcher rib 19, as well as vertical swinging movement of the dome 16 and stretcher 19 ribs, when the centerpost 12** is vertically positioned, as the umbrella is opened.

This invention has been disclosed and described in connection with a rib linkage system 13 where the dome ribs 16 are each of a length that extends from the peripheral edge 25 of the umbrella's cover 11 to the umbrella's center post 12, i.e., where the dome ribs are directly connected to the umbrella's centerpost. However, an umbrella with shirred edge cover 11 in accord with the principles of this invention may also be used with a topless rib linkage system, one example of which is illustrated in U.S. Pat. No. 3,467,115, owned by the assignee of this application. And indeed, the advantages of this invention are equally applicable when employed with a topless umbrella rib linkage system, one example of which is disclosed in that U.S. Pat. No. 3,467,115. Accordingly, the disclosure of that U.S. Pat. No. 3,467,115, and the incorporation of a shirred edge cover 11 in accord with the principles of this invention in combination with a topless umbrella rib linkage system one example of which is disclosed in that patent, is incorporated herein by reference.

Having described in detail the preferred embodiment of my invention, what I desire to claim and protect by Letters Patent is:

1. An umbrella comprising:

a centerpost.

a rib linkage system connected to said centerpost, said rib linkage system having a series of dome ribs radially oriented relative to said centerpost when said umbrella is open, and a cover iece connected to said rib linkage system, and at least a portion of other peripheral edge of said cover piece being shirred, the shirred edge portion of said cover piece being stretchable circumferentially to a greater peripheral length when said umbrella is opened, and contractable circumferentially to a lesser peripheral length when said umbrella is collapsed, and said cover piece being flat when spread out on a flat surface prior to shirring of said cover's edge portion.

2. An umbrella as set forth in claim 1, said cover piece comprising a unitary one-piece configuration as cut.

3. An umbrella as forth in claim 1, said cover piece comprising a generally polygonal configuration as cut, the number of edges of that polygonal configuration being equal to the number of dome ribs included in said rib linkage system.

4. An umbrella as set forth in claim 3, at least one of the edge portions of that polygonal configuration being shirred.

5. An umbrella as set forth in claim 4, said cover comprising an irregular polygonal configuration as cut, that configuration providing an even number of lesser length edge portions that alternate with an even number of greater length edge portions, at least one of the lesser length edge portions being shirred.

6. An umbrella as set forth in claim 5, all of said lesser length portions being shirred.

7. An umbrella as set forth in claim 5, the length of each lesser length edge portion being between about forty percent and about eighty percent of the length of a greater length edge portion, the lesser length edge portions all being substantially equal in length and the greater length edge portions all being substantially equal in length.

8. An umbrella as set forth in claim 1, said shirred edge portion comprising an elastic band fixed to said cover piece's edge, said elastic band cooperating with said edge portion to effect the shirring of that edge portion, and said elastic band having a longitudinal axis oriented generally parallel to the periphery of said edge portion prior to being fixed thereto.

9. An umbrella as set forth in claim 8. said elastic band having a length between about forty percent and about eighty percent of that portion of the cover's edge being shirred as measured before that portion is shirred.

10. An umbrella as set forth in claim 9, the shirred edge portion of said cover's edge being positioned between a pair of adjacent ribs.

11. An umbrella as set forth in claim 1, said cover piece being cut from a material that is essentially non-stretchable in warp and weft directions.

12. An umbrella as set forth in claim 1, said shirred portion of the peripheral edge of said cover piece being of a length substantially less than the entire length of the peripheral edge of said cover piece, and the non-shirred portion of the peripheral edge of said cover piece being essentially non-stretchable

* * * * *

UNITED STATES PATENT AND TRADEMARK OFFICE

CERTIFICATE OF CORRECTION

PATENT NO. : 4,794,939

DATED : January 3, 1989

INVENTOR(S) : Toshio Okuda

It is certified that error appears in the above-identified patent and that said Letters Patent is hereby corrected as shown below:

Column 2, line 25 delete "throughput" and insert -- throughout --.

Column 3, line 47 delete "relation" and insert -- relationship

Column 5, line 29 delete "iece" and insert -- piece --.

Signed and Sealed this

Twenty-seventh Day of February, 1990

*Attest:*

JEFFREY M. SAMUELS

*Attesting Officer*

*Acting Commissioner of Patents and Trademarks*